US006219994B1

(12) United States Patent
Taniguchi

(10) Patent No.: US 6,219,994 B1
(45) Date of Patent: Apr. 24, 2001

(54) METHOD AND SYSTEM FOR MAIL PROCESSING

(75) Inventor: Akihiro Taniguchi, Ichikawa (JP)

(73) Assignee: NTT Comware Corporation, Tokyo (JP)

( * ) Notice: Subject to any disclaimer, the term of this patent is extended or adjusted under 35 U.S.C. 154(b) by 0 days.

(21) Appl. No.: 09/267,233

(22) Filed: Mar. 12, 1999

(30) Foreign Application Priority Data

Mar. 12, 1998 (JP) ..... 10-061775

(51) Int. Cl.[7] ..... B65B 21/06

(52) U.S. Cl. ..... 53/147; 53/203; 209/900; 493/11

(58) Field of Search ..... 493/11; 209/900; 53/147, 203

(56) References Cited

U.S. PATENT DOCUMENTS

| | | | |
|---|---|---|---|
| 5,005,124 | 4/1991 | Connell et al. | 209/900 |
| 5,292,004 | 3/1994 | Cesarini | 209/900 |
| 5,470,427 | 11/1995 | Mikel et al. | 209/900 |
| 5,538,138 | 7/1996 | Reich | 209/900 |
| 5,901,855 | 5/1999 | Uno et al. | 209/900 |
| 5,910,998 | 6/1999 | Yui | 209/900 |

FOREIGN PATENT DOCUMENTS 60-220179 11/1985 (JP) .

*Primary Examiner*—Eugene Kim
(74) *Attorney, Agent, or Firm*—Jordan and Hamburg LLP

(57) ABSTRACT

A mail wrapping system apparatus for preparing for mailing postal items includes receiving trays for respectively receiving postal items from companies and an extraction device for extracting from the postal items a multiplicity of same address groups of the postal items, each of the same address groups consisting of ones of the postal items having coinciding ones of destination addresses. A wrapping unit respectively individually assembles each of the same address groups into a bundle and successively wraps each of the same address groups assembled using a wrapping component with a corresponding one of the destination addresses respectively displayed on each of the wrapped same address groups to provide for mailing the wrapped same address groups. A weight sorter then sorts the wrapped same address groups into weight divisions set forth by a fee schedule of a specified delivery agency and the wrapped same address groups are sent with appropriate postage.

41 Claims, 6 Drawing Sheets

*Fig. 4*

UNIT : YEN

| | WEIGHT DIVISION (UP TO) | ORDINARY MAIL | SPECIAL LOCAL MAIL (BASIC DISCOUNT RATES) | SPECIAL LOCAL MAIL (SPECIAL DISCOUNT RATES) |
|---|---|---|---|---|
| STANDARD-SIZE ITEM | 25 g | 80 | 65 | 50 |
| | 50 g | 90 | 75 | 55 |
| NON-STANDARD-SIZE ITEM | 50 g | 120 | 100 | 75 |
| | 75 g | 140 | 115 | 85 |
| | 100 g | 160 | 130 | 95 |
| | 150 g | 200 | 160 | 120 |
| | 200 g | 240 | 195 | 145 |
| | 250 g | 270 | 220 | 165 |

[SAVED EXPENSE WHEN FOUR POSTAL ITEMS ARE WRAPPED INTO A SINGLE PACKAGE (TOTAL WEIGHT : 75 TO 100 g)]

- POSTAGE PER POSTAL ITEM : 95 YEN / 4 ITEMS≒ 24 YEN/ITEM
- SAVING PER SENDING ORGANIZATION : 80 YEN − 24 YEN = 56 YEN/ITEM

Fig. 5

(a)

| ORGANIZATION | NUMBER OF POSTAL ITEMS | POSTAGE (YEN) | ESTIMATED POSTAGE SAVING (YEN) |
|---|---|---|---|
| DIRECT MAIL COMPANY | 2.0 BILLION | 160 BILLION | 85.0 BILLION |
| CREDIT CARD COMPANY | 1.0 BILLION | 80 BILLION | 42.5 BILLION |
| KEY TELEPHONE COMPANY | 0.7 BILLION | 40 BILLION | 30.0 BILLION |
| BANKING ORGAN | 0.5 BILLION | 40 BILLION | 21.0 BILLION |
| GOVERNMENT OFFICE | 0.5 BILLION | 40 BILLION | 21.0 BILLION |
| PUBLIC CORPORATION | 0.2 BILLION | 16 BILLION | 8.5 BILLION |
| CELLULAR PHONE COMPANY | 0.1 BILLION | 8 BILLION | 4.0 BILLION |
| TOTAL | 5.0 BILLION | 384 BILLION | 212.0 BILLION |

(b)

PROFIT OF MAIL WRAPPING SERVICE COMPANY

| FEE | | NUMBER OF POSTAL ITEMS HANDLED | | PROFIT |
|---|---|---|---|---|
| 2 YEN/ITEM | × | 5 BILLION ITEMS | = | 10 BILLION YEN |

EQUIPMENT INVESTMENT :
5 BILLION YEN

- ADDRESSEE–BASED ITEMS EXTRACTION UNIT : 2.5 BILLION YEN (0.5 BILLION YEN ×5 UNITS)
- CENTER REMODELING : 2.5 BILLION YEN (0.5 BILLION YEN ×5 LOCATIONS)

*Fig. 6*

| MON | TUES | WED | THURS | FRI | SAT | SUN |
|---|---|---|---|---|---|---|
| ·IN-HOUSE BULLETIN<br>·POSTCARD | ·PRIVATE SCHOOL (DIRECT MAIL) | | GROUP A 5TH | ·DIRECT MAIL COMPANY<br>·DRUG STORE (DIRECT MAIL) | | |
| ·SECURITIES COMPANY<br>·DIRECT MAIL<br>·POSTCARD ×3 | GROUP B 10TH<br>·SECURITIES COMPANY<br>·CREDIT CARD COMPANY (STATEMENT) | ·KEY TELEPHONE COMPANY (BILL)<br>·MONTHLY MAGAZINE<br>·POSTCARD | ·DIRECT MAIL ×2 | | | 15TH |
| GROUP C 16TH<br>·MONTHLY MAGAZINE | | | | GROUP D 20TH<br>·CREDIT CARD COMPANY (STATEMENT)<br>ISSUE : DEC 16<br>DUE : DEC 27 | | |
| ·IN-HOUSE BULLETIN<br>·LEASING COMPANY (STATEMENT)<br>·WATERWORKS BUREAU (BILL) | ·CELLULAR PHONE COMPANY (BILL)<br>·HOUSING COMPANY (DIRECT MAIL) | GROUP E 25TH | | ·CREDIT CARD COMPANY (STATEMENT)<br>ISSUE : DEC 24<br>DUE : JAN 13 | | |
| GROUP F 30TH<br>·BANK (ACCOUNT REPORT)<br>·IN-HOUSE BULLETIN<br>·DEPARTMENT STORE (DIRECT MAIL) | ·SOCIAL INSURANCE OFFICE (PENSION PLAN, ETC.) | | | | | |

| DATE OF ISSUE OF BILL BY KEY TELEPHONE COMPANY | | | |
|---|---|---|---|
| | GROUP A (5TH) | GROUP B (10TH) | GROUP C (15TH) |
| | GROUP D (20TH) | GROUP E (25TH) | GROUP F (30TH) |

METHOD AND SYSTEM FOR MAIL PROCESSING

BACKGROUND OF THE INVENTION

The present invention relates to a method and a system unit of mail wrapping, more specifically, to a method of mail wrapping and a mail wrapping system unit used to execute the method for grouping a multiplicity of address-indicated postal items, as issued and collected from a plurality of companies of various industries, at a facility in accordance with a coincidence of the destination addresses respectively expressed on said address-indicated postal items. And the present invention is designed to be used when the companies of the various industries have the address-indicated postal items (including enveloped letters and postcards intended to be delivered via a specified delivery agency and addressee-specific correspondences on which the addresses and names of the addressees are indicated in advance such as bills and account statements) respectively and at the same time the companies want to send the address-indicated postal items all together to the same addressees of households or enterprises at one time.

When a key telephone company, cellular phone companies, public corporations such as electric power companies or gas supply companies (including waterworks bureau), banking organs, credit card companies, mail-order houses that operate product sales by a direct mail method (referred to as "direct mail companies" hereinafter), government offices, and any companies of various types of industries (government offices are referred to as a part of companies in various types of industries, hereinafter) send any type of correspondence to their respective customers (including enterprises), they usually deposit such postal items in post offices individually and independently.

FIG. 6 shows the types of postal items delivered to some household. As shown in the figure, it clearly indicates that a lot of postal items are delivered to the household scattered at random over the weekdays in a given month. It is also obvious that there are many postal items, each of which carries a specific document (an exceptional correspondence on which the address and name are expressed in advance), that are issued periodically and delivered such as bills and account statements prepared by the respective companies. (For example, the key telephone company issues telephone bills once every five days, though depending on the customers' districts, and the credit card company issues account statements on specified days of the month.)

As in the typical case of the key telephone company which sends bills to the respective users of its telephone services, most companies which send postal items to their customers utilize postage discount systems available to them such as basic discount rates or special discount rates for special local mail services in order to minimize their mailing costs. The average annual postage cost of these companies in connection with postal items sent to their respective customers stands at several billion yen and in an extreme case, a company of some industry spends more than 100 billion yen a year on postage.

The circumstances do not in any way inconvenience the customers, since no customers are obliged to pay for the postage of such postal items. However, if the postal charges shouldered by such companies are increased sharply due to a revision of the Postal Law, the companies will have no alternative but to pass along the increased cost to their service charges. As a solution to this problem in the future, some companies are studying plans to send a large percentage of their postal items through private carriers which recently feature much lower service charges than the postal services.

In the conventional delivery method of postal items, a lot of postal items of similar types, such as bills and account statements, are delivered separately at random on different days of any given month, which is bothersome to some customers who believe it convenient to receive bills and account statements on a single fixed day every month and settle each payment at a bank or the like at one time.

Also post offices are under the pressure of dramatically increased indoor handling work resulting from a huge volume of mail deposited each time by different companies in different industries. With the yearly increasing number of postal items handled at post offices, it is likely that efficient transportation and delivery of these postal items will be seriously affected in the future.

Such problems as those mentioned above may be solved easily if the different companies of different industries cooperate in collecting, whether periodically or not, the address-indicated postal items issued by the companies all together at one time, sorting such postal items by forming groups of postal items having the same destination addresses, and further depositing the postal items in a specified delivery agency such as a post office or a private carrier. However, no such intensive operation systems have been initiated as yet.

SUMMARY OF THE INVENTION

Under these circumstances set forth above, major objects to be achieved by the present invention are as follows.

That is, a first object of the present invention is to provide a method and a system unit of mail wrapping which realize a substantial reduction in the charges or postage of address-indicated postal items which are sent to respective customers by companies.

A second object of the present invention is to provide a method and a system unit of mail wrapping which will alleviate the inconvenience of receiving postal items on the part of the recipients of address-indicated postal items.

A third object of the present invention is to provide a method and a system unit of mail wrapping which will substantially reduce the volume of address-indicated postal items, the number of deliveries, and the indoor handling work at delivery agencies.

Other objects of the present invention will become apparent from the specification and drawings, and especially from the description of claims.

As a means of solving the problems mentioned above, the present invention comprises the steps of: extracting groups of same-address-indicated postal items having same destination addresses from address-indicated postal items of different companies which are collected at a single facility; wrapping the groups of the same-address-indicated postal items as collected group by group; and applying a multiplicity of bundled address-indicated postal items as respectively wrapped for use in depositing in a postal office or a private carrier.

In the present invention, "Address-indicated postal items" refers to all types of postal items with their respective destination addresses indicated in advance, including all types of correspondence having destination addresses indicated in advance for use when enclosed in envelopes with a transparent film panel in such manner that the address indication can be identified from the outside of each envelope. Bills and account statements in particular are referred to as "Exceptional correspondences" as they are special correspondences on which the names and addresses of the addressees are indicated, while advertisement leaflets are referred to as "General correspondences" as they are general correspondences without any indication of the names and addresses of the addressees.

More specifically, in order to solve the problems mentioned above, the present invention is practiced by using novel constituent methods and means whose features are listed below, including generic concepts and more specific concepts.

That is, a first feature of the method of the present invention resides in a method of mail wrapping, applied prior to any one company's mailing a multiplicity of address-indicated postal items of any type to each of destination addresses expressed thereon, comprising steps of: collecting the address-indicated postal items issued from a plurality of companies of various industries; grouping the address-indicated postal items as collected into a multiplicity of bundled address-indicated postal items wrapped singly in accordance with a coincidence of the destination addresses expressed on the address-indicated postal items; and depositing the bundled address-indicated postal items in a specified delivery agency, so as to previously simplify respective steps of accepting, sorting and delivering of the address-indicated postal items in the specified delivery agency.

A second feature of the method of the present invention resides in a method of mail wrapping which has the first feature of the method mentioned above, wherein the step of grouping the address-indicated postal items as collected comprises steps of: extracting a multiplicity of groups of same-address-indicated postal items respectively expressing the destination addresses which coincide with each other from the address-indicated postal items as collected; lumping each of the groups of the same-address-indicated postal items; and wrapping each of the groups of the same-address-indicated postal items as lumped by means of a specified wrapping component of sufficient size to contain each of the groups thereof, so as to obtain the bundled address-indicated postal items.

A third feature of the method of the present invention resides in a method of mail wrapping which has the second feature of the method mentioned above, further comprising a step of sorting each of the bundled address-indicated postal items in accordance with respective weight divisions under a delivery fee schedule adopted by the specified delivery agency.

A fourth feature of the method of the present invention resides in a method of mail wrapping which has the second or third feature of the method mentioned above, wherein the step of extracting the groups of the same-address-indicated postal items is executed by directly retrieving each of the destination addresses expressed on the address-indicated postal items.

A fifth feature of the method of the present invention resides in a method of mail wrapping which has the second or third feature of the method mentioned above, wherein the step of extracting the groups of the same-address-indicated postal items is executed by retrieving standard code information indicated previously in a visually confirmable area on each of the address-indicated postal items, the standard code information identifying each of the destination addresses corresponding thereto.

A sixth feature of the method of the present invention resides in a method of mail wrapping which has the fifth feature of the method mentioned above, wherein the standard code information is indicated with a code of a telephone number for a subscriber telephone service by a key telephone company, the telephone number representing a constituent body at a location of each of the destination addresses.

A seventh feature of the method of the present invention resides in a method of mail wrapping which has the second or third feature of the method mentioned above, wherein the step of lumping each of the groups of the same-address-indicated postal items is executed by outwardly direct an indication side of a destination address expressed on a fixed postal item placed at a topmost position of each of the groups thereof, and the step of wrapping each of the groups thereof is executed by applying an envelope with a transparent film panel which positioned in a required area thereof as the specified wrapping component, the transparent film panel made of any transparent film material, so that an indication of the destination address on the fixed postal item of each of the groups thereof is visible from outside through the transparent film panel.

A eighth feature of the method of the present invention resides in a method of mail wrapping which has the seventh feature of the method mentioned above, wherein the envelope with the transparent film panel is made entirely of the transparent film material, and an outer area of the required area in which the transparent film panel is positioned is made opaque.

A ninth feature of the method of the present invention resides in a method of mail wrapping which has the seventh feature of the method mentioned above, wherein the outer area of the required area in which the transparent film is positioned is made of any opaque material.

A tenth feature of the method of the present invention resides in a method of mail wrapping which has the seventh feature of the method mentioned above, wherein a film envelope of which at least a front surface thereof is made entirely of the transparent film material is applied to serve as the specified wrapping component instead of the envelope with the transparent film panel, so that at least the indication of the destination address on the fixed postal item of each of the groups of the same-address-indicated postal items is visible from outside through the front surface of the film envelope.

A eleventh feature of the method of the present invention resides in a method of mail wrapping which has the tenth feature of the method mentioned above, wherein a substitutional indication equivalent to the indication of the destination address expressed on each of the groups of the same-address-indicated postal items is expressed on the front surface of the film envelope corresponding thereto, instead of making the indication of the destination address on the fixed postal item of each of the groups thereof visible from outside through the front surface of the film envelope.

A twelfth feature of the method of the present invention resides in a method of mail wrapping which has the seventh feature of the method mentioned above, wherein a net type container bag made entirely of any net formation is applied to serve as the specified wrapping component instead of the envelope with the transparent film panel, so that at least the indication of the destination address on the fixed postal item of each of the groups of the same-address-indicated postal items is directly visible from outside of the net type container bag through gaps thereof.

A thirteenth feature of the method of the present invention resides in a method of mail wrapping which has the seventh feature of the method mentioned above, wherein a transparent band wrapper made entirely of any transparent film material is applied to serve as the specified wrapping component instead of the envelope with the transparent film panel, so that at least the indication of the destination address on the fixed postal item of each of the groups of the same-address-indicated postal items is visible from outside through a front surface of the transparent band wrapper.

A fourteenth feature of the method of the present invention resides in a method of mail wrapping which has the seventh feature of the method mentioned above, wherein the address-indicated postal items respectively assume a form of sealed postal items.

A fifteenth feature of the method of the present invention resides in a method of mail wrapping which has the fourteenth feature of the method mentioned above, wherein each of the sealed postal items issued respectively from the companies of the various industries has an approximately uniformed size.

A sixteenth feature of the method of the present invention resides in a method of mail wrapping which has the fourteenth feature of the method mentioned above, wherein a component of the sealed postal items assumes a form of which has a transparent film panel so that an indication of a destination address previously expressed on an enclosure therein is visible through the transparent film panel.

A seventeenth feature of the method of the present invention resides in a method of mail wrapping which has the fourteenth feature of the method mentioned above, wherein a component of the sealed postal items assumes a form of a sealed postal letter on which a postage-processed indication has been expressed, assuming that the sealed postal letter is to be deposited in a post office as the specified delivery agency.

A eighteenth feature of the method of the present invention resides in a method of mail wrapping which has the fourteenth feature of the method mentioned above, wherein a component of the sealed postal items assumes a form of a sealed postal package on which no postage-processed indication has been expressed, assuming that the sealed postal package is to be deposited in a private carrier as the specified delivery agency.

A nineteenth feature of the method of the present invention resides in a method of mail wrapping which has the seventh feature of the method mentioned above, wherein a component of the address-indicated postal items assumes a form of a postcard on which a postage-processed indication has been expressed, assuming that the postcard is to be deposited in a post office as the specified delivery agency, and the step of lumping each of the groups of the same-address-indicated postal items is executed by placing the postcard at any position other than the topmost position of each of the groups thereof.

A twentieth feature of the method of the present invention resides in a method of mail wrapping which has the seventh feature of the method mentioned above, wherein a component of the address-indicated postal items assumes a form of an exceptional correspondence with an indication of a destination address but impracticable for mailing in itself, and the step of lumping each of the groups of the same-address-indicated postal items is executed by placing the exceptional correspondence at any position other than the topmost position of each of the groups thereof.

A twenty-first feature of the method of the present invention resides in a method of mail wrapping which has the twentieth feature of the method mentioned above, wherein the exceptional correspondence is allowed to be placed at the topmost position of each of the groups of the same-address-indicated postal items, only in case that the envelope with the transparent film panel is applied to serve as the specified wrapping component.

A twenty-second feature of the method of the present invention resides in a method of mail wrapping which has the seventh feature of the method mentioned above, wherein a general correspondence without an indication of a destination address is further enclosed in all of the bundled address-indicated postal items, in which the general correspondence is placed at any position other than the topmost position of each of the groups of the same-address-indicated postal items.

A twenty-third feature of the method of the present invention resides in a method of mail wrapping which has the seventh feature of the method mentioned above, wherein a general correspondence without an indication of a destination address is further enclosed only in each of the bundled address-indicated postal items that having a room in weight classified in accordance with the respective weight divisions under the delivery fee schedule adopted by the specified delivery agency, in which the general correspondence is placed at any position other than the topmost position of each of the groups of the same-address-indicated postal items.

A twenty-fourth feature of the method of the present invention resides in a method of mail wrapping which has the second or third feature of the method mentioned above, wherein the step of lumping each of the groups of the same-address-indicated postal items is executed by allowing to inwardly direct an indication side of a destination address expressed on a fixed postal item placed at a topmost position of each of the groups thereof, in which any type of the fixed postal item is to be placed at the topmost position, and the step of wrapping each of the groups thereof is executed by applying an opaque envelope made entirely of any opaque material as the specified wrapping component, in which a substitutional indication equivalent to the indication of the destination address expressed on each of the groups thereof is expressed on a front surface of the opaque envelope.

A twenty-fifth feature of the method of the present invention resides in a method of mail wrapping which has the twenty-fourth feature of the method mentioned above, wherein an opaque band wrapper made entirely of any opaque material is applied to serve as the specified wrapping component instead of the opaque envelope, in which a substitutional indication equivalent to the indication of the destination address expressed on each of the groups thereof is expressed on a front surface of the opaque band wrapper.

A twenty-sixth feature of the method of the present invention resides in a method of mail wrapping which has the twenty-fourth feature of the method mentioned above, wherein the address-indicated postal items mainly assume a form of sealed postal items of any type, in which at least two components of the sealed postal items respectively assume a form of a sealed postal letter on which a postage-processed indication has been expressed and of a sealed postal package on which no postage-processed indication has been expressed, assuming that the sealed postal letter and the sealed postal package are respectively to be deposited in a post office and in a private carrier as the specified delivery agency, and in addition to the sealed postal items, at least two components of the address-indicated postal items respectively assume a form of a postcard on which a postage-processed indication has been expressed, assuming that the postcard is to be deposited in a post office as the specific delivery agency, and of an exceptional correspondence with an indication of a destination address but impracticable for mailing in itself.

A twenty-seventh feature of the method of the present invention resides in a method of mail wrapping which has the twenty-fourth feature of the method mentioned above, wherein a general correspondence without an indication of a destination address is further enclosed in all of the bundled address-indicated postal items.

A twenty-eighth feature of the method of the present invention resides in a method of mail wrapping which has the twenty-fourth feature of the method mentioned above, wherein a general correspondence without an indication of a destination address is further enclosed only in each of the bundled address-indicated postal items that having a room in weight classified in accordance with the respective weight divisions under the delivery fee schedule adopted by the specific delivery agency.

A twenty-ninth feature of the method of the present invention resides in a method of mail wrapping which has the twentieth feature of the method mentioned above, wherein an isolated exceptional correspondence is wrapped singly, the isolated exceptional correspondence to be appeared in case that the address-indicated postal items respectively expressing the destination addresses which coincide each other are not extracted in the step of extracting the groups of the same-address-indicated postal items.

A thirtieth feature of the method of the present invention resides in a method of mail wrapping which has the fourteenth feature of the method mentioned above, wherein an isolated address-indicated postal item of any kind is wrapped singly, the isolated address-indicated postal item to be appeared in case that the address-indicated postal items respectively expressing the destination addresses which coincide each other are not extracted in the step of extracting the groups of the same-address-indicated postal items.

A thirty-first feature of the method of the present invention resides in a method of mail wrapping which has the fourteenth feature of the method mentioned above, wherein an isolated address-indicated postal item of any kind is not wrapped singly, the isolated address-indicated postal item to be appeared in case that the address-indicated postal items respectively expressing the destination addresses which coincide each other are not extracted in the step of extracting the groups of the same-address-indicated postal items, in which a postage-processed indication expressed on the isolated address-indication postal item is modified, in case of need, into an appropriate indication allowing the isolated address-indicated postal item to be handled singly.

On the other hand, a first feature of the system unit of the present invention resides in a system unit of mail wrapping, applied prior to any company's mailing a multiplicity of address-indicated postal items of any type to each of destination addresses expressed thereon, for grouping the address-indicated postal items as issued and collected from a plurality of companies of various industries into a multiplicity of bundled address-indicated postal items wrapped singly at a facility in accordance with a coincidence of the destination addresses expressed on the address-indicated postal items, so as to previously simplify respective steps of accepting, sorting and delivering of the address-indicated postal items in a specified delivery agency, comprising: a plurality of receiving trays for respectively receiving the address-indicated postal items issued and collected form each of the companies of the various industries, the address-indicated postal items from each of the companies previously sorted into respective divisions of specified delivery areas covered by the specified delivery agency; an extraction means for extracting a multiplicity of groups of same-address-indicated postal items respectively expressing the destination addresses which coincide each other from the address-indicated postal items as received in the receiving trays; and a wrapping means for lumping each of the groups of the same-address-indicated postal items as extracted by the extraction means and successively wrapping each of the groups thereof as lumped by means of a specific wrapping component of sufficient size to contain each of the groups thereof.

A second feature of the system unit of the present invention resides in a system unit of mail wrapping which has the first feature of the system unit mentioned above, further comprising a weight sorting means for sorting each of the bundled address-indicated postal items as wrapped from each of the groups of the same-address-indicated postal items by the wrapping means in accordance with respective weight divisions under a delivery fee schedule adopted by the specific delivery agency.

A third feature of the system unit of the present invention resides in a system unit of mail wrapping which has the first or second feature of the system unit mentioned above, wherein the extraction means directly retrieves each of the destination addresses expressed on the address-indication postal items for extracting the groups of the same-address-indicated postal items.

A fourth feature of the system unit of the present invention resides in a system unit of mail wrapping which has the first or second feature of the system unit mentioned above, wherein each of the address-indicated postal items has standard code information indicated previously in a visually confirmable area on each thereof, the standard code information identifying each of the destination addresses corresponding thereto, and the extraction means retrieves the standard code information indicated on each of the address-indication postal items for extracting the groups of the same-address-indicated postal items.

A fifth feature of the system unit of the present invention resides in a system unit of mail wrapping which has the fourth feature of the system unit mentioned above, wherein the standard code information is indicated with a code of a telephone number for a subscriber telephone service by a key telephone company, the telephone number representing a constituent body at a location of each of the destination addresses.

A sixth feature of the system unit of the present invention resides in a system unit of mail wrapping which has the first or second feature of the system unit mentioned above, wherein the wrapping means outwardly direct an indication side of a destination address expressed on a fixed postal item placed at a topmost position of each of the groups of the same-address-indicated postal items in lumping each of the groups thereof, in case that a front surface of the specified wrapping component as applied allows a visual confirmation of an indication of the destination address on the fixed postal item from outside thereof.

A seventh feature of the system unit of the present invention resides in a system unit of mail wrapping which has the sixth feature of the system unit mentioned above, wherein the specified wrapping component is an envelope with a transparent film panel which positioned in a required area thereof, the transparent film panel made of any transparent film material.

A eighth feature of the system unit of the present invention resides in a system unit of mail wrapping which has the seventh feature of the system unit mentioned above, wherein the envelope with the transparent film panel is made entirely of the transparent film material, and an outer area of the required area in which the transparent film panel is placed is made opaque.

A ninth feature of the system unit of the present invention resides in a system unit of mail wrapping which has the seventh feature of the system unit mentioned above, wherein the outer area of the required area in which the transparent film is placed is made of any opaque material.

A tenth feature of the system unit of the present invention resides in a system unit of mail wrapping which has the sixth feature of the system unit mentioned above, wherein the specified wrapping component is a film envelope of which at least a front surface thereof is made entirely of any transparent film material.

A eleventh feature of the system unit of the present invention resides in a system unit of mail wrapping which has the tenth feature of the system unit mentioned above, wherein the wrapping means further comprises a sub-expression means for expressing a substitutional indication equivalent to the indication of the destination address expressed on each of the groups of the same-address-indicated postal items on the front surface of the film envelope corresponding thereto.

A twelfth feature of the system unit of the present invention resides in a system unit of mail wrapping which has the sixth feature of the system unit mentioned above, wherein the specified wrapping component is a net type container bag made entirely of any net formation.

A thirteenth feature of the system unit of the present invention resides in a system unit of mail wrapping which has the sixth feature of the system unit mentioned above, wherein the specified wrapping component is a transparent band wrapper made entirely of any transparent film material.

A fourteenth feature of the system unit of the present invention resides in a system unit of mail wrapping which has the sixth feature of the system unit mentioned above, wherein the address-indicated postal items respectively assume a form of sealed postal items.

A fifteenth feature of the system unit of the present invention resides in a system unit of mail wrapping which has the fourteenth feature of the system unit mentioned above, wherein each of the sealed postal items issued respectively from the companies of the various industries has an approximately uniformed size.

A sixteenth feature of the system unit of the present invention resides in a system unit of mail wrapping which has the fourteenth feature of the system unit mentioned above, wherein a component of the sealed postal items assumes a form of which has a transparent film panel so that an indication of a destination address previously expressed on an enclosure therein is visible through the transparent film panel.

A seventeenth feature of the system unit of the present invention resides in a system unit of mail wrapping which has the fourteenth feature of the system unit mentioned above, wherein a component of the sealed postal items assumes a form of a sealed postal letter on which a postage-processed indication has been expressed, assuming that the sealed postal letter is to be deposited in a post office as the specified delivery agency.

A eighteenth feature of the system unit of the present invention resides in a system unit of mail wrapping which has the fourteenth feature of the system unit mentioned above, wherein a component of the sealed postal items assumes a form of a sealed postal package on which no postage-processed indication has been expressed, assuming that the sealed postal package is to be deposited in a private carrier as the specified delivery agency.

A nineteenth feature of the system unit of the present invention resides in a system unit of mail wrapping which has the sixth feature of the system unit mentioned above, wherein a component of the address-indicated postal items assumes a form of a postcard on which a postage-processed indication has been expressed, assuming that the postcard is to be deposited in a post office as the specified delivery agency, and the wrapping means places the postcard at any position other than the topmost position of each of the groups of the same-address-indicated postal items in lumping each of the groups thereof.

A twentieth feature of the system unit of the present invention resides in a system unit of mail wrapping which has the sixth feature of the system unit mentioned above, wherein a component of the address-indicated postal items assumes a form of an exceptional correspondence with an indication of a destination address but impracticable for mailing in itself, and the wrapping means places the exceptional correspondence at any position other than the topmost position of each of the groups of the same-address-indicated postal items in lumping each of the groups thereof.

A twenty-first feature of the system unit of the present invention resides in a system unit of mail wrapping which has the twentieth feature of the system unit mentioned above, wherein the wrapping means allowably places the exceptional correspondence at the topmost position of each of the groups of the same-address-indicated postal items, only in case that the envelope with the transparent film panels are applied as the specified wrapping component.

A twenty-second feature of the system unit of the present invention resides in a system unit of mail wrapping which has the sixth feature of the system unit mentioned above, wherein the wrapping means further encloses a general correspondences without an indication of a destination address in all of the bundled address-indicated postal items, in which the general correspondence is placed at any position other than the topmost position of each of the groups of the same-address-indicated postal items.

A twenty-third feature of the system unit of the present invention resides in a system unit of mail wrapping which has the sixth feature of the system unit mentioned above, wherein the wrapping means further encloses a general correspondences without an indication of a destination address only in each of the bundled address-indicated postal items that having a room in weight classified in accordance with the respective weight divisions under the delivery fee schedule adopted by the specified delivery agency, in which the general correspondence is placed at any position other than the topmost position of each of the groups of the same-address-indicated postal items.

A twenty-fourth feature of the system unit of the present invention resides in a system unit of mail wrapping which has the first or second feature of the system unit mentioned above, wherein the wrapping means allows to inwardly direct an indication side of a destination address expressed on a fixed postal item placed at a topmost position of each of the groups of the same-address-indicated postal items in lumping each of the groups of the same-address-indicated postal items, in which any type of the fixed postal item is to be placed at the topmost position, in case that the specified wrapping component as applied does not allow a visual confirmation of an indication of the destination address on the fixed postal item from outside thereof.

A twenty-fifth feature of the system unit of the present invention resides in a system unit of mail wrapping which has the twenty-fourth feature of the system unit mentioned above, a system unit, wherein the specified wrapping component is an opaque envelope made entirely of any opaque material, and the wrapping means further comprises a sub-expression means for expressing a substitutional indication equivalent to the indication of the destination address expressed on each of the groups of the same-address-indicated postal items on a front surface of the opaque envelope corresponding thereto.

A twenty-sixth feature of the system unit of the present invention resides in a system unit of mail wrapping which has the twenty-fourth feature of the system unit mentioned above, wherein the specified wrapping component is an opaque band wrapper made entirely of any opaque material, and the wrapping means further comprises a sub-expression means for expressing a substitutional indication equivalent to the indication of the destination address expressed on each of the groups of the same-address-indicated postal items on a front surface of the opaque band wrapper corresponding thereto.

A twenty-seventh feature of the system unit of the present invention resides in a system unit of mail wrapping which has the twenty-fourth feature of the system unit mentioned above, wherein the address-indicated postal items mainly assume a form of sealed postal items of any type, in which at least two components of the sealed postal items respectively assume a form of a sealed postal letter on which a postage-processed indication has been expressed and of a sealed postal package on which no postage-processed indication has been expressed, assuming that the sealed postal letter and the sealed postal package are respectively to be deposited in a post office and in a private carrier as the specified delivery agency, and in addition to the sealed postal items, at least two components of the address-indicated postal items respectively assume a form of a postcard on which a postage-processed indication has been expressed, assuming that the postcard is to be deposited in a post office as the specific delivery agency, and of an exceptional correspondence with an indication of a destination address but impracticable for mailing in itself.

A twenty-eighth feature of the system unit of the present invention resides in a system unit of mail wrapping which has the twenty-fourth feature of the system unit mentioned above, wherein the wrapping means further encloses a general correspondences without an indication of a destination address in all of the bundled address-indicated postal items.

A twenty-ninth feature of the system unit of the present invention resides in a system unit of mail wrapping which has the twenty-fourth feature of the system unit mentioned above, wherein the wrapping means further encloses a general correspondences without an indication of a destination address only in each of the bundled address-indicated postal items that having a room in weight classified in accordance with the respective weight divisions under the delivery fee schedule adopted by the specified delivery agency.

A thirtieth feature of the system unit of the present invention resides in a system unit of mail wrapping which has the twentieth feature of the system unit mentioned above, wherein the wrapping means singly wraps an isolated exceptional correspondence to be appeared in case that the address-indicated postal items respectively expressing the destination addresses which coincide each other are not extracted by the extraction means.

A thirty-first feature of the system unit of the present invention resides in a system unit of mail wrapping which has the fourteenth feature of the system unit mentioned above, wherein the wrapping means singly wraps an isolated address-indicated postal item of any kind to be appeared in case that the address-indicated postal items respectively expressing the destination addresses which coincide each other are not extracted by the extraction means.

A thirty-second feature of the system unit of the present invention resides in a system unit of mail wrapping which has the fourteenth feature of the system unit mentioned above, wherein the wrapping means does not singly wrap an isolated address-indicated postal item of any kind to be appeared in case that the address-indicated postal items respectively expressing the destination addresses which coincide each other are not extracted by the extraction means, in which the wrapping means comprises an expression modifying means for modifying, in case of need, a postage-processed indication expressed on the isolated address-indication postal item into an appropriate indication allowing the isolated address-indicated postal item to be handled singly.

DESCRIPTION OF THE DRAWINGS

While the specification concludes with claims particularly pointing out and distinctly claiming the subject matter of the present invention, it is believed the invention will be better understood from the following description taken in connection with the accompanying drawings in which:

FIG. 4 shows expense saved per company resulting from wrapping two or more postal items according to the present invention;

FIG. 5 (*a*) shows an estimated annual postage saving resulting from realizing the present invention along with a number of postal items and postage and FIG. (*b*) shows an annual profit of a mail wrapping company in charge of a mail wrapping facility realizing the present invention; and FIG. 6 shows types of postal items delivered to a household over a period of one month.

DETAILED DESCRIPTION OF THE INVENTION

By reference to the accompanying drawings, the premises and outline of the embodiment of the present invention are described, followed by the descriptions of the modes for realizing the invention represented herein by embodiment examples of systems and methods in the present invention, and an investment effect expected from realizing the present invention is described additionally. In the embodiment example of the present invention taken herein, the intensive processing of two or more address-indicated postal items involves postal items in the form of enveloped letters, which are wrapped for delivery through post offices.

Figure 1:
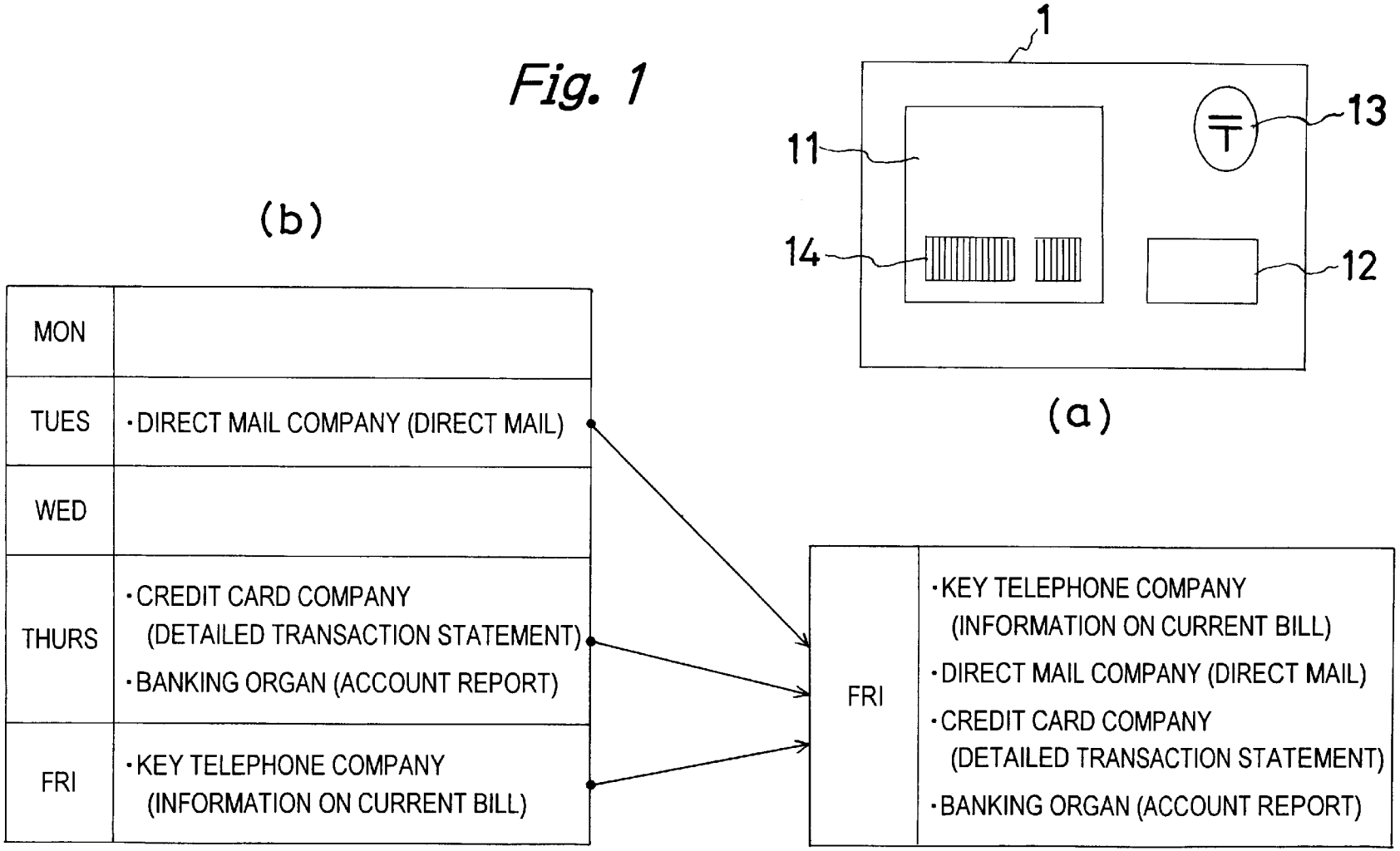
FIG. 1 (*a*) shows an example of an address-indicated postal item utilized in realizing the present invention and FIG. 1 (*b*) shows an example of a delivery schedule of address-indicated postal items prepared by companies which cooperate in the embodiment of the present invention.

FIG. 1 (*a*) and (*b*) show an example of an address-indicated postal item utilized in realizing the present invention and an example of a delivery schedule of the address-indicated postal items prepared by companies which cooperated in the embodiment of the present invention respectively.

As shown in FIG. 1 (*a*), in realizing the present invention, the companies may use an envelope 1 which is one of the companies' respective envelopes for address-indicated postal items in the form of a sealed postal item (sealed postal letter) for sending bills and account statements as the address-indicated postal items to be sent to each customer of each company as is. This type of envelope 1 usually has a transparent film panel for the indication of the destination address (name and address of the addressee) 11 through which an address indication indicated on an enclosure (no numeral is given in the figure), which includes such an exceptional correspondence as an account statement, can be identified from the outside of the envelope 1. Further, in this example, there is a transparent film panel 12 for indication of the sender (name of the company) through which the sender can be identified from the outside of the envelope 1. On the upper right hand corner of the envelope 1, there may be a postage-processed indication 13, to indicate post-payment of postage, printed in advance for depositing the item in a post office.

Preferably, standard code information to identify the destination address (address of the addressee) of each address-indicated postal item should be indicated at a visually confirmable location on the surface of the envelope 1 (But it is not indispensable). In this example, a bar code 14, indicated in advance on the enclosure and which can be identified from the outside of the envelope 1 through the transparent film panel 12 for the indication of the destination address along with the corresponding address indication, is used as the carrier of the standard code information indication. This bar code 14 in particular should ideally employ a telephone number (including both analog and ISDN lines, hereinafter) used in the subscriber telephone service of the key telephone company for example, in order to uniquely identify the address of the customer.

If a constituent body of the destination address indicated on the envelope 1 is a single household, usually only a single telephone line is involved in the subscriber telephone service, and the telephone number of the household defines all the members of the family in the household simultaneously (one of the telephone numbers assigned to the household if the household has contracted for two or more service lines). In the case of a company, a representative telephone number can be used to define all the sections and departments in the company. In other words, standard code information is required to identify only the destination address on the envelope 1. Even if the standard code information does not help identify the respective names of customers at a particular constituent body, the customers themselves experience no difficulty in receiving the bundled address-indicated postal items in the present invention simultaneously and can get their own items by opening the wrapping.

The standard code information embodied in the form of the bar code 14 is not necessarily indicated in advance on the enclosure as shown in this example. For instance, a seal or stamp (both not shown in the figure,) for expressing the information may be impressed directly onto the surface of the envelope 1. In short, a necessary and sufficient condition of the standard code information is to indicate the information at a visually confirmable area of each address-indicated postal item (preferably on the address-indicated side of each address-indicated postal item). It is also preferable that the size of the envelope 1 as used by a plurality of companies is uniform through the respective companies in consideration of functions realized by a mail wrapping system unit discussed later. (A detailed description is presented later.)

In addition to the envelope 1 (sealed postal item) mentioned above, the address-indicated postal items may be home-delivery items handled by private carrier services in the form of sealed postal packages (not shown in the figure) which are prepared on the premise that they are to be deposited in a private carrier, in addition to postcards to be deposited in the post offices. Furthermore, an exceptional correspondence which is not sealed inside any envelope, such as bills and account statements, may be accepted.

Now describing the exceptional correspondence, herein meaning personal data items, such as bills and account statements in more detail, these types of the correspondence in most cases carry personal information (charges etc.) related to services provided by the companies to each customer and ideally are handled via the use of sealed envelopes as a rule. Most companies today use two-piece or three-piece forms in which address indication sections and correspondence contents sections (sections indicating respective statements) are divided by a perforated line for easy separation of the sections. The correspondence is folded along the perforated lines between the address indication sections and correspondence contents sections before being dispatched from each company so that the correspondence contents sections are sealed to be invisible from the surface of the postal items (address-indicated surfaces). (In some forms, the correspondence contents sections are folded inwards and the contents cannot be viewed even from the rear side of the postal items.) It means such exceptional correspondences can be handled in the same manner as types of address-indicated postal items in the form of sealed postal items or postal items in the form of postcards without any risk of leaking personal information to third parties provided that the respective companies handle them carefully and responsibly.

Referring to FIG. 1 (*b*), the companies may, in realizing the present invention, preferably unify the respective issuing days or dispatch days of the address-indicated postal items including bills, account statements, and notifications to be wrapped together into a fixed day of any week or month (which is Friday according to the example shown in the figure). As a matter of course, the unification should not be compulsory. However, unification of dispatch days will ease intensive processing of a huge volume of address-indicated postal items at one time to result in the advantageous reduction of the unit price required to send each address-indicated postal item, which is realized by realizing the mail wrapping system unit discussed later.

Figure 2:
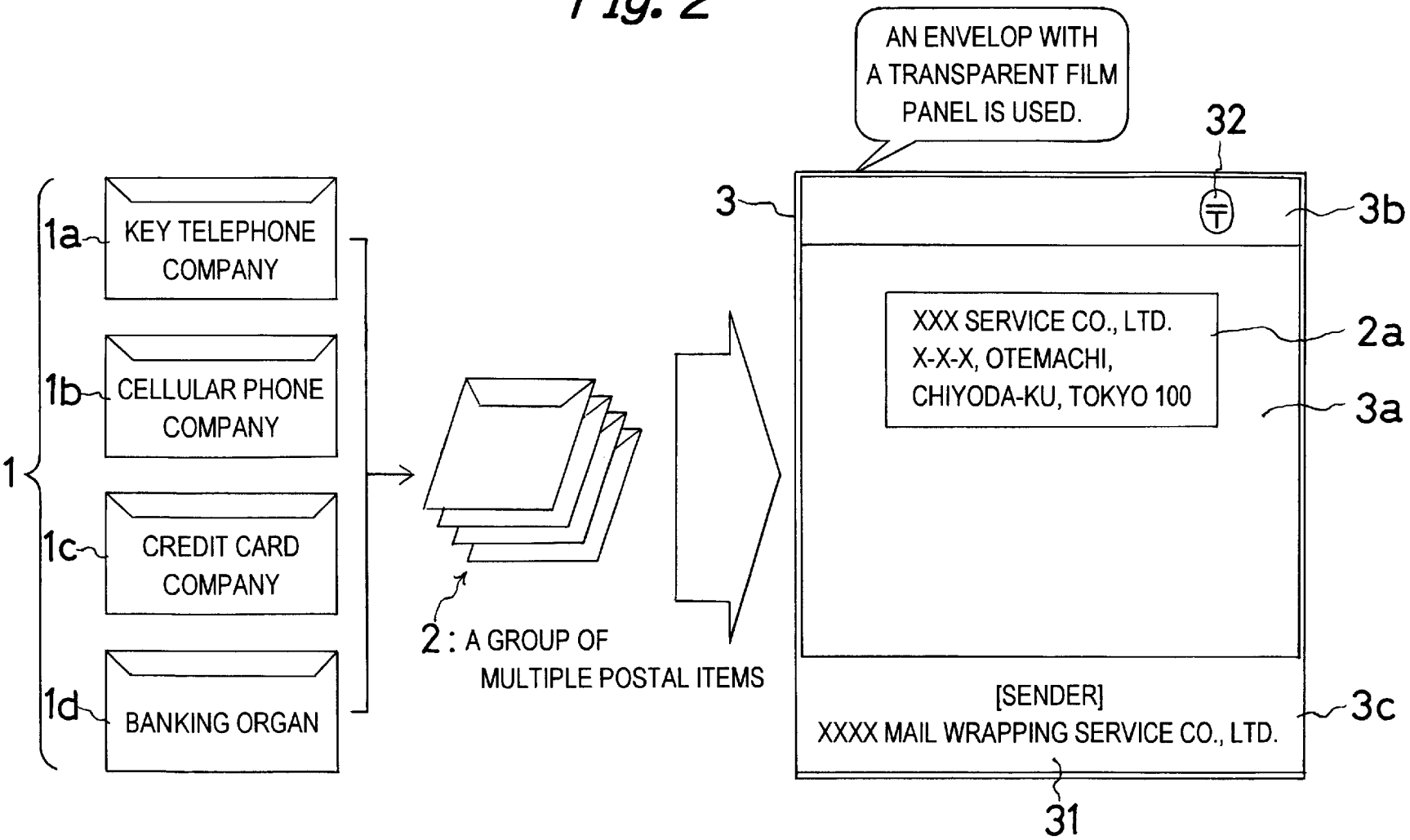
FIG. 2 is a conceptual drawing of the present invention.

FIG. 2 is a conceptual drawing of the present invention. For the purpose of simplification, the descriptions hereafter take postal items in the form of sealed postal letters and postal items in the form of postcards as an example mode of address-indicated postal items according to the present invention, which are referred to as a "postal item" as a common single category.

As shown in this figure, in realizing the present invention, groups of multiple postal items 2, having respectively, the same above-mentioned standard code information group by group (bar code 14 indicating the telephone number) which are indicated on the address indication side of the postal items in advance, are extracted from two or more postal items 1*a*, 1*b*, 1*c* and 1*d* comprising at least the envelopes 1 that are addressed to the customers of various types of companies such as a key telephone company, cellular phone company, credit card company, or a banking organ. (In the drawing only one group of multiple postal items 2 is shown, however, in an actual embodiment of the present invention, two or more groups thereof will be extracted.) After the step of extraction, each group of multiple postal items 2 is wrapped using a wrapping envelope 3 as a specific wrapping component made as an integrated envelope of any transparent film material.

The wrapping envelope 3 is made in such manner that an address indication side of a fixed postal item 2*a* placed in a topmost position of the group of multiple postal items 2 can be seen from the outside through the transparent film panel 3*a* when the group thereof is wrapped. In this example, a indication of the sender 31, which comprises the name of the company which is in charge of the facility using the wrapping method of the present invention is used in lieu of the indication of the sender (not shown in this figure), which prepares the fixed postal item 2*a*. A postage-processed stamp impression 32 impressed by the company in charge of the facility using the wrapping method in the present invention, is used in lieu of the postage-processed indication (not shown in this figure) impressed for the fixed postal item 2*a*.

In this wrapping envelope 3, the outer areas 3*b* and 3*c*, in which the indication of the sender 31 and the postage-processed stamp impression 32 are indicated are opaque in an actual embodiment of the present invention. The outer areas 3*b* and 3*c* are colored white for example to make the area non-transparent so that the indication of sender and the postage-processed indication of the fixed postal item 2*a* cannot be visually identified from the outside. It means a truly transparent area on the surface side of the wrapping envelope 3 is limited to the area (transparent film panel 3*a*) where the indication of the addressee indicated on the fixed postal item 2*a* can be visually confirmed from the outside. On the other hand, the rear side of the wrapping envelope 3 can be either transparent or opaque. Where necessary, for an envelope in which the non-transparent areas 3*b* and 3*c* and the rear side are separately formed, any opaque material, such as paper, can be used as an alternative to the wrapping envelope 3.

Figure 3:
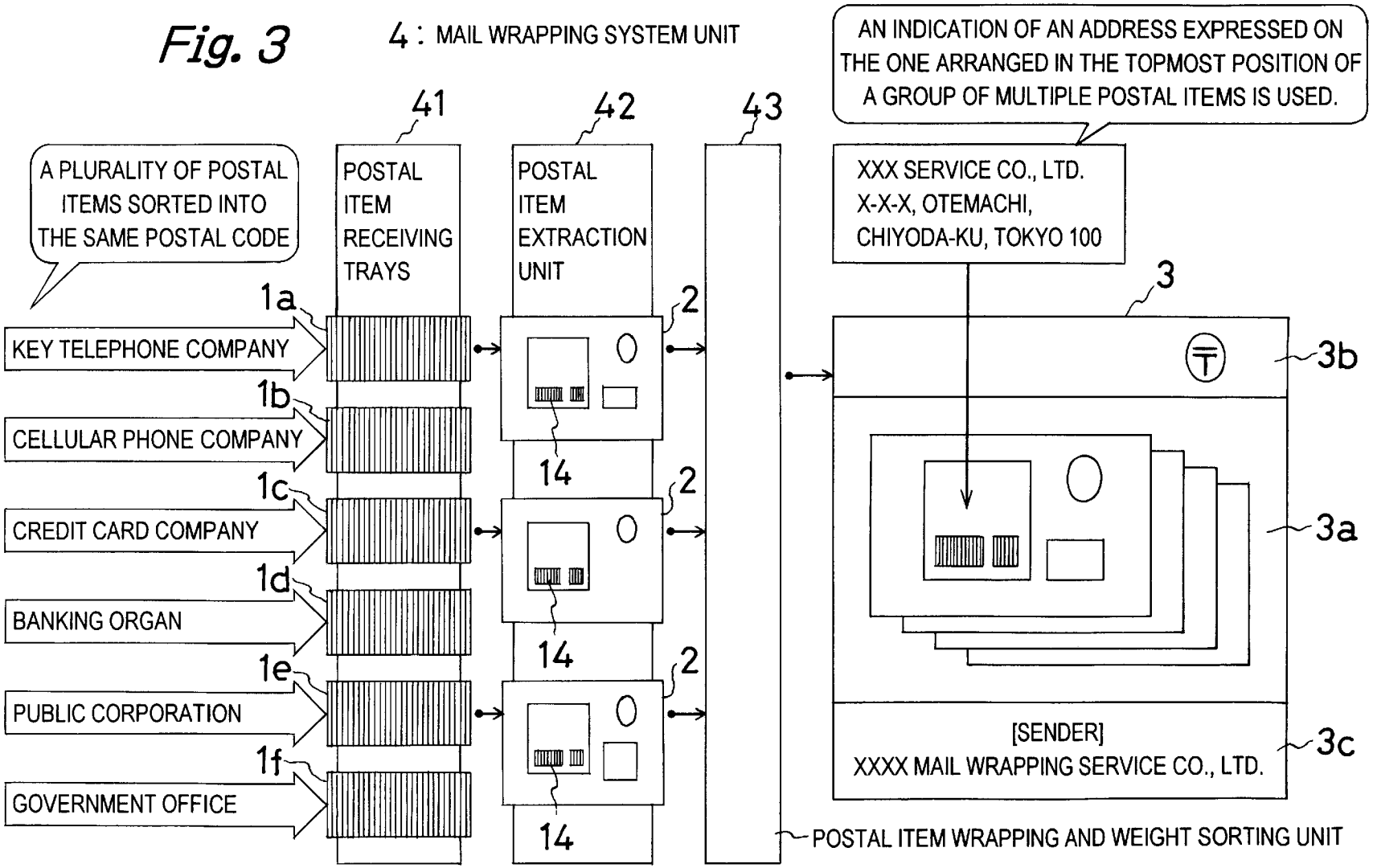
FIG. 3 is a functional block diagram of an embodiment example of a mail wrapping system unit in the present invention.

An example of the system unit of mail wrapping in the present invention is described as follows. FIG. 3 is a functional block diagram of an embodiment example of the mail wrapping system unit in the present invention.

As shown in FIG. 3, the mail wrapping system unit 4 in the example of the present invention comprises: postal item receiving trays 41 (a plurality of receiving trays) for receiving a plurality of postal items 1*a*–1*f* which are sorted for respective delivery areas into groups having, for example, the same postal code at respective companies such as a key telephone company, cellular phone company, credit card company, banking organ, public corporation, government office; the postal item receiving trays 41 receiving the groups of the postal items 1*a*–1*f* company by company, postal item extraction unit (extraction means) 42 for extracting groups of the multiple postal items 2 one after another out from the postal items 1*a*–1*f* which have been received in the respective postal item receiving trays 41 provided for the respective companies by, for example, optically retrieving the standard code information (bar code 14) indicated on each address indication side of the postal items 1*a*–1*f* and further lumping, or assembling the groups of the multiple postal items 2 having the same standard code information; and mail wrapping and weight sorting unit (wrapping means and weight sorting means) 43 for the steps of directing the groups of the multiple postal items 2 extracted by the postal item extraction unit 42, wrapping the groups of the multiple postal items 2 as lumped via the use of the wrapping envelope 3 one after another, and sorting the wrapping envelopes 3 which wrap the groups of the multiple postal items 2 in the form of bundled postal items (bundled address-indicated postal items) in accordance with the weight divisions specified under a delivery fee schedule adopted by the post office one after another.

Though not shown in the figure, the mail wrapping and weight sorting unit 43 may be provided with an expression modifying means for modifying the postage-processed stamp impression, (postage-processed indication) of a single postal item (not shown in the figure) when the postal items having the same standard code information from the items 1*a*–1*f* of two or more companies are not extracted, into a type of indication which will allow the single postal item to be handled as an isolated address-indicated postal item.

An example of the method to be embodied in the mail wrapping system unit 4 constructed as mentioned above is described as follows.

When the companies of various industries respectively send the postal items 1*a*–1*f* addressed to their respective customers at a time, the standard code information (bar code 14), to identify the destination addresses, are indicated in advance on the respective visually confirmable areas on the address indication sides of the postal items 1*a*–1*f* and the postal items 1*a*–1*f* are sorted into specified delivery areas. These postal items 1*a*–1*f*, preprocessed as mentioned above, are collected, whether periodically or not, at a facility from the two or more companies. At this point, the postal items 1*a*–1*f* which have been sorted for delivery areas should preferably be sorted further for the delivery orders. This preprocessing prepares a proper sorted condition of the postal items, without need for a further sorting step, in the final stage of the operation of the mail wrapping system unit in which the groups of the multiple postal items 2 are respectively wrapped in the wrapping envelope 3 group by group.

Then, the groups of the multiple postal items 2 having the same standard code information are extracted group by group from the postal items 1*a*–1*f* collected from the companies by, for example, optically reading the standard code information indicated on each surface of those postal items and the groups of the multiple postal items 2 extracted as mentioned above are sorted one group after another with a front surface of the fixed postal item 2*a* in the topmost position of the group directed outwards. Then, the groups of multiple postal items 2 are wrapped one group after another via the use of the wrapping envelope 3. As mentioned above, indication of the standard code information is not an indispensable condition in the example of the present invention. If the standard code information is not used, the destination addresses indicated on the postal items 1*a*–1*f* may be directly read via the use of, for example, an OCR (optical character reader).

Finally, the wrapping envelopes 3, which contain the groups of the multiple postal items 2 are each sorted in accordance with the specified weight division, one envelope after another, and the sorted wrapping envelopes 3 after all the processes mentioned above are deposited as newly formed postal items with weight divisions, with the post offices which cover the respective delivery areas identified in the preprocessing.

When the address-indicated postal items having the same destination address are not extracted from the two or more postal items 1*a*–1*f* collected from two or more companies in the extracting step above, an isolated address-indicated postal item of any type can be handled singly. In this case, the postal-processed indication on the isolated address-indicated postal item should be modified into a type of indication suitable for the handling of the postal item as an individual postal item. Alternatively the isolated address-indicated postal item may be wrapped via the use of the wrapping envelope 3 in the same manner as with the multiple postal items 2, as a matter of course.

The following points should be noted when at least a postal item in the form of a postcard is wrapped together with other envelopes 1. For example, when the envelope 1 is wrapped together with at least one postcard, positioning the postcard in the topmost position of the same-address-indicated postal items and wrapping them all together via the use of the wrapping envelope 3 may, due to the difference in sizes between the envelope 1 and the postcard, result in the address indication on the postcard being deviated from a position which allows the address indication to be visually confirmable through the wrapping envelope 3. (In consideration of this problem, it is recommended that the envelopes 1 used by different companies employ an approximately uniform size and in addition, the wrapping envelopes 3 should be of a size sufficient to accommodate the envelopes 1.) So, when at least the postcard is included among two or more postal items wrapped by the method in the present invention, it is necessary that the postcard should be placed at any position other than the topmost position (second or below). If the size of the envelope 1 is unified into that of the postcard, the position of the postcard need not be specified, since the above-mentioned problem will not be caused in this condition.

In addition to the above, the functions of the mail wrapping and weight sorting unit 43 may be utilized further for enclosing general correspondence, which alone cannot be accepted as an individual postal item (not shown in the figure) in an ordinary postal service, into all of the two or more wrapping envelopes 3 or into particular wrapping envelopes 3 which have an allowance against the upper limit value of each weight division. In this case, the general correspondence must be placed at any position other than the topmost position of all the items wrapped together so that the address indication of the same-address-indicated postal item 2*a*, placed topmost in the group of two or more multiple postal items 2, can be visually identified from the outside through the transparent film panel 3*a*.

Following the descriptions of the examples of the system unit and method in the present invention above, the economical effect available through realizing the present invention is described additionally as follows.

As shown in FIG. 4 (a figure showing the expense saved per company resulting from wrapping two or more postal items), when four postal items which are accepted as special local mail (special discount rates) are wrapped into a single package, with the total weight of the wrapping envelope 3 being within the weight range of 75 g through 100 g, the postage of the wrapping envelope 3 will be 95 yen, which results in the postage per postal item placed therein being approximately 24 yen. As a result, the saved expense per company by realizing the present invention will amount to almost 56 yen, compared with sending the same as a standard-sized postal item (80 yen) under prior art.

Further, as shown in FIG. 5 (where FIG. (*a*) shows the estimated annual postage saving resulting from realizing the present invention along with the number of postal items and postage, and FIG. (*b*) shows the profit of a mail wrapping company in charge of a mail wrapping facility utilizing the present invention), the amount of saving in the postal charge resulting from sending a single wrapped postal item prepared by wrapping two postal items, which is still accepted as special local item (special discount rates. 75 yen), compared with the postage in sending the two postal items separately as two standard-size items (80 yen×2 items=160 yen) will stand at more than 50 percent. Part of the estimated postage saving may be invested for founding a mail wrapping company and a handling charge of 2 yen per item may be collected for the operating costs of the mail wrapping company's facility, so that the mail wrapping company itself can expect a profit of approximately 10 billion yen which is far beyond the equipment investment of 5 billion yen, provided that the facility processes approximately 5 billion postal items per year.

The descriptions above take postal items in the form of the sealed postal letters and the postcards together for an example mode of address-indicated postal items. However, as mentioned above, the present invention may be realized with home-delivery items handled by private carrier services in the form of the sealed postal package and the exceptional correspondences in the same manner as with the above-mentioned. In this case, when wrapping two or more exceptional correspondences without including any other postal item, the sizes of these two or more exceptional correspondences of different companies are recommended to be unified to an approximately uniform size as in the above-mentioned case of wrapping the envelope 1. On the other hand, when mixing the exceptional correspondences with other address-indicated postal items, as in the above-mentioned case of wrapping the postal items in the form of postcards together with the envelope 1, a contrivance or other is required to place the exceptional correspondence at any position other than the topmost position of the grouped items if the exceptional correspondence is smaller than the envelope 1. (When these items are all one size, the exceptional correspondence may be placed topmost.)

As an alternative to the wrapping envelope 3, a film envelope (not shown in the figure) whose front side at least is made entirely of transparent film material to provide a corner-to-corner transparent film panel on the front side, may be used depending on the circumstances in realizing the present invention. In this case, the indications of the sender and the postage-processed stamp impression indicated on the fixed postal item placed in the topmost position can be visually identified from the outside. Such envelopes will be sufficiently practical in realizing the present invention if the positions of the above-mentioned indications of the sender and postage-processed stamp impression are conveniently covered by the indication of sender 31 and the postage-processed stamp impression 32 indicated on the wrapping envelope 3. (Though depending on the circumstances, the indication of the sender and the postage-processed stamp impression on the fixed postal item, being made purposely visible, may be used for mailing purposes.) Further, in this case, the mail wrapping and weight sorting unit 43 may be provided with a sub-expression for expressing a substitutional indication so that the destination address indicated on the single same-address-indicated postal item (a group of same-address-indicated postal items) will be indicated as an alternative address on the front surface of the corresponding film envelope.

Furthermore, the specific wrapping component may, in addition to the types mentioned above, be a net type container bag (not shown in the figure) which is made entirely of any net formation, a transparent band wrapper made entirely of any transparent film material, or an opaque wrapper made entirely of any opaque material such as paper or the like (not shown in the figure, both), or an opaque envelope which is made entirely of any opaque material such as paper or the like (not shown in the figure), as required. When an opaque band wrapper or envelope is used, the destination address indicated on the single same-address-indicated postal item may be indicated as a substitutional expression equivalent thereto on the front surface of the corresponding opaque band wrapper or envelope by use of the sub-expression means. (Any type of a single same-address-indicated postal item above, such as any address-indicated postal item inclusive of exceptional and general correspondences, may be accepted and as a matter of course, the address-indicated surface may also be directed inwards.)

In case any other wrapping component other than the above-mentioned wrapping envelope 3 is used in realizing the present invention, the example of embodiment via the use of the wrapping envelope 3 should naturally be followed in connection with the method of enclosing at least one general correspondence, the wrapping of a single exceptional correspondence which is likely to result in an actual case, wrapping types of single address-indicated postal items, or correcting postage. In addition, it is also possible to deposit bundled address-indicated postal items with a private carrier instead of the post office.

While a preferred embodiment of the invention has been described above, it is to be understood that the invention is not limited in its application to the descriptions and figures presented herein and modifications may be made without departing from the spirit and scope of the present invention which allows the advantageous effects of the invention mentioned below.

As has been described above, the present invention will not only greatly reduce the expenses related to each company's sending address-indicated postal items such as that mail addressed to each customer of the company, but will also alleviate the inconvenience of receiving postal items on the part of the recipients of address-indicated postal items. In addition to the above, it will enable the substantial reduction of the volume of address-indicated postal items, the number of deliveries, and indoor handling work at a post office or private carrier. Furthermore, with the reduced costs for sending items in general, utilization of postal services including the delivery of direct mail will presumably be most increased.

What is claimed is:

1. A mail wrapping system apparatus for preparing for mailing via a specified delivery agency postal items from a plurality of companies, having destination addresses of recipients indicated thereon, to respective ones of said destination addresses in accordance with a coincidence of said destination addresses, the mail wrapping system apparatus comprising:

receiving trays for respectively receiving said postal items from each of said companies, said postal items from each of said companies being previously sorted into respective divisions of specified delivery areas covered by said specified delivery agency;

extraction means for extracting from said postal items in the receiving trays a multiplicity of same address groups of said postal items, each of said same address groups consisting of ones of said postal items having coinciding ones of said destination addresses;

wrapping means for respectively individually assembling each of said same address groups into a bundle and successively wrapping each of said same address groups assembled using a wrapping component with a corresponding one of said destination addresses respectively displayed on each of said wrapped same address groups to provide for mailing said wrapped same address groups; and weight sorting means for sorting said wrapped same address groups into weight divisions set forth by a fee schedule of said specified delivery agency.

2. The mail wrapping system apparatus according to claim 1, wherein said extraction means directly reads said destination addresses expressed on said postal items for extracting said same address groups.

3. The mail wrapping system apparatus according to claim 1, wherein at least one of said postal items has standard code information in a visually confirmable area, said standard code information representing a respective one of said destination addresses, and said extraction means reads said standard code information for extracting said same address groups of said postal items.

4. The mail wrapping system apparatus according to claim 3, wherein said standard code information is a code of a telephone number, said telephone number representing a recipient at corresponding ones of said destination addresses.

5. The mail wrapping system apparatus according to claim 1, wherein:

said postal items have an indication side whereon said destination addresses are indicated;

said wrapping means outwardly directs said indication side of a topmost one of said postal items in individual ones of said wrapped same address groups; and said wrapping component allows the display of said destination address on said topmost one of said postal items.

6. The mail wrapping system apparatus according to claim 5, wherein said wrapping component is an envelope with a transparent film panel which is positioned to permit said display of said destination address.

7. The mail wrapping system apparatus according to claim 6, wherein said envelope with said transparent film panel is made entirely of transparent film material, and at least a selected area of said transparent film material is made opaque.

8. The mail wrapping system apparatus according to claim 6, wherein said wrapping component has at least an area outside of said transparent film panel made of an opaque material.

9. The mail wrapping system apparatus according to claim 5, wherein said wrapping component is a film envelope of which at least a front surface thereof is made of a transparent film material.

10. The mail wrapping system apparatus according to claim 9, wherein said wrapping means further comprises a means for placing an indication of said destination address of said same address groups on said front surface of said film envelope corresponding thereto.

11. The mail wrapping system apparatus according to claim 5, wherein said wrapping component is a net type container bag made of a net.

12. The mail wrapping system apparatus according to claim 5, wherein said wrapping component is a transparent band wrapper made of transparent film material.

13. The mail wrapping system apparatus according to claim 5, wherein said postal items are sealed postal items.

14. The mail wrapping system apparatus according to claim 13, wherein each of said sealed postal items has an approximately uniform size.

15. The mail wrapping system apparatus according to claim 13, wherein at least one of said sealed postal items has a transparent film panel allowing display of a destination address on an enclosure.

16. The mail wrapping system apparatus according to claim 13, wherein at least one of said sealed postal items is a sealed postal letter having a postage-processed indication thereon for depositing in a post office as said specified delivery agency.

17. The mail wrapping system apparatus according to claim 13, wherein at least one of said sealed postal items is a sealed postal package having no postage-processed indication thereon, said sealed postal package being intended for deposit in a private carrier as said specified delivery agency.

18. The mail wrapping system apparatus according to claim 5, wherein at least one of said postal items is a postcard having a postage-processed indication thereon for depositing in a post office as said specified delivery agency, and said wrapping means places said postcard at a position such that said postcard is not said topmost of said postal items in said same address groups.

19. The mail wrapping system apparatus according to claim 5, wherein at least one of said postal items is an exceptional correspondence having personal data and an indication of said destination address thereon and lacking an outer covering, and said wrapping means places said exceptional correspondence at a position such that said postcard is not said topmost of said postal items in said same address groups.

20. The mail wrapping system apparatus according to claim 5, wherein said postal items include an exceptional correspondence having personal data and said destination address thereon, said wrapping means disposes said exceptional correspondence as said topmost one of said postal items only when said wrapping component is an envelope with a transparent film panel.

21. The mail wrapping system apparatus according to claim 5, wherein said wrapping means further encloses a general correspondences without an indication of said destination address in said same address groups such that said general correspondence is not said topmost one of said postal items.

22. The mail wrapping system apparatus according to claim 5, wherein said wrapping means further encloses a general correspondences without an indication of said destination address only in ones of said same address groups having a weight less than a weight limit of at least one of said weight divisions, and said general correspondence is disposed so as not to be said topmost one of same postal items.

23. The mail wrapping system apparatus according to claim 1, wherein said wrapping means assembles said postal items without respect to an indication side of said postal items having said destination address displayed, and said wrapping component does not allow a visual observation of said postal items.

24. The mail wrapping system apparatus according to claim 23, wherein said wrapping component is an opaque envelope, and said wrapping means further comprises a means for placing an indication of said destination address of said same address groups on said front surface of said film envelope corresponding thereto.

25. The mail wrapping system apparatus according to claim 23, wherein said specified wrapping component is an opaque band wrapper, and said wrapping means further comprises a means for placing an indication of said destination address of said same-address groups on said front surface of said film envelope corresponding thereto.

26. The mail wrapping system apparatus according to claim 23, wherein:

said postal items include sealed postal items which include:

a sealed postal letter having a postage-processed indication for depositing in a post office as said specified delivery agency; and a sealed postal package having no postage-processed indication for depositing with a private carrier as said specified delivery agency; and said postal items include:

a postcard having a postage-processed indication for depositing in a post office as said specified delivery agency; and an exceptional correspondence having personal data and an indication of said destination address thereon and lacking an outer covering.

27. The mail wrapping system apparatus according to claim 23, wherein said wrapping means further encloses a general correspondence without an indication of said destination address in all of said wrapped same address groups.

28. The mail wrapping system apparatus according to claim 23, wherein said wrapping means further encloses a general correspondence without an indication of said destination address only in ones of said same address groups having a weight less than a weight limit of at least one of said weight divisions.

29. The mail wrapping system apparatus according to claim 19, wherein:

at least one of said postal items is an isolated exceptional correspondence having personal data and an indication of said destination address thereon and lacking an outer covering, said postal items being devoid of other ones of said postal items having said destination address of said another exceptional correspondence; and said wrapping means singly wraps said isolated exceptional correspondence with said destination address thereof displayed.

30. The mail wrapping system apparatus according to claim 13, wherein:

at least one of said postal items is an isolated one of said postal items, said postal items being devoid of other ones of said postal items having said destination address of said isolated one of said postal items; and said wrapping means singly wraps said isolated one of said postal items with said destination address thereof displayed.

31. The mail wrapping system apparatus according to claim 13, wherein:

at least one of said postal items is an isolated one of said postal items, said postal items being devoid of other ones of said postal items having said destination address of said isolated one of said postal items;

said wrapping means excludes wrapping said isolated one of said postal items; and said wrapping means further comprises an expression modifying means for modifying a postage-processed indication on said isolated one of said postal items into an appropriate indication allowing said isolated one of said postal items to be forwarded singly.

32. A mail wrapping system apparatus for preparing for mailing postal items, having destination addresses of recipients indicated thereon, to respective ones of said destination addresses in accordance with a coincidence of said destination addresses, the mail wrapping system apparatus comprising:

a receptacle for receiving said postal items;

extraction means for extracting from said postal items in said receptacle same address groups of said postal items, each of said same address groups consisting of ones of said postal items having coinciding ones of said destination addresses;

wrapping means for respectively individually assembling each of said same address groups into a bundle and successively wrapping each of said same address groups assembled using a wrapping component with a corresponding one of said destination addresses respectively displayed on each of said wrapped same address groups to provide for mailing said wrapped same address groups; and weight sorting means for sorting said wrapped same address groups into weight divisions set forth by a fee schedule of a delivery agency.

33. The mail wrapping system apparatus according to claim 32, further comprising means for indicating on said wrapped same address groups a postage-processed indication corresponding to the fee schedule of said delivery agency.

34. The mail wrapping system apparatus according to claim 33, wherein said extraction means directly reads each of said destination addresses expressed on said postal items for extracting said same address groups.

35. The mail wrapping system apparatus according to claim 34, wherein at least one of said postal items has said destination address thereon indicated by a standard code, and said extraction means reads said standard code information for extracting said same address groups of said postal items.

36. The mail wrapping system apparatus according to claim 32, wherein said extraction means directly reads each of said destination addresses expressed on said postal items for extracting said same address groups.

37. The mail wrapping system apparatus according to claim 36, wherein at least one of said postal items has said destination address thereon indicated by a standard code, and said extraction means reads said standard code information for extracting said same address groups of said postal items.

38. The mail wrapping system apparatus according to claim 32, wherein:

said postal items have an indication side whereon said destination addresses are indicated;

said wrapping means outwardly directs said indication side of a topmost one of said postal items in individual ones of said wrapped same address groups; and said wrapping component allows the display of said destination address on said topmost one of said postal items.

39. The mail wrapping system apparatus according to claim 38, wherein said wrapping component is an envelope with at least a transparent film portion which is positioned to permit said destination address of respective ones of said wrapped same address groups.

40. The mail wrapping system apparatus according to claim 38, further comprising means for indicating on said wrapped same address groups a postage-processed indication corresponding to the fee schedule of said delivery agency.

41. The mail wrapping system apparatus according to claim 32, wherein said wrapping means for further comprises a means for placing an indication of said destination address of respective ones of said same address groups on said wrapping component to effect said display of said destination address.

* * * * *